United States Patent [19]

Husain et al.

[11] 4,291,538

[45] Sep. 29, 1981

[54] POWER PRODUCING DRY COOLING APPARATUS AND METHOD

[75] Inventors: Matloob Husain, Wheaton; Ban-Yen Lai, Willowbrook; James B. Maher, Oak Brook, all of Ill.

[73] Assignee: Chicago Bridge & Iron Company, Oak Brook, Ill.

[21] Appl. No.: 109,562

[22] Filed: Jan. 4, 1980

[51] Int. Cl.[3] ..... F01K 9/00; F01K 23/04

[52] U.S. Cl. ..... 60/661; 60/655; 60/692; 60/686

[58] Field of Search ..... 60/686, 690, 692, 661, 60/655

[56] References Cited

U.S. PATENT DOCUMENTS

| | | | |
|---|---|---|---|
| 4,004,424 | 1/1977 | Maddagiri | 60/690 X |
| 4,037,413 | 7/1977 | Heller et al. | 60/690 X |
| 4,212,168 | 7/1980 | Bouchard et al. | 60/692 X |

*Primary Examiner*—Allen M. Ostrager

*Attorney, Agent, or Firm*—Merriam, Marshall & Bicknell

[57] ABSTRACT

Spent steam from a steam driven electric generating power plant is condensed by heat rejection to a refrigerant in a closed loop. The closed refrigerant loop contains an expander and a compressor, and a heat exchanger in a cooling tower. The compressor and expander are integrated so that (1) in an upper cooling cycle at the upper end of the ambient or air temperature range, only the compressor is operated within its operating range, (2) in a lower cooling cycle at the lower end of the ambient or air temperature range, only the expander is operated and (3) in a middle cooling cycle at the middle range of the ambient or air temperatures, when the turn-down of either the compressor or the expander is a limiting factor, both of them are operated.

The characteristics of the compressor and the expander are advisably matched such that when both are operated the duties on both are balanced above their respective turn-down limits thus minimizing the energy loss and enhancing the power producing capability of the system. The integrated compressor/expander operation, during the middle range of the ambient or air temperatures in which the system is designed to operate, will also provide smoother operation, as the discontinuity going to and from the compressor to the expander mode of operation is eliminated.

27 Claims, 2 Drawing Figures

POWER PRODUCING DRY COOLING APPARATUS AND METHOD

Figure 1:
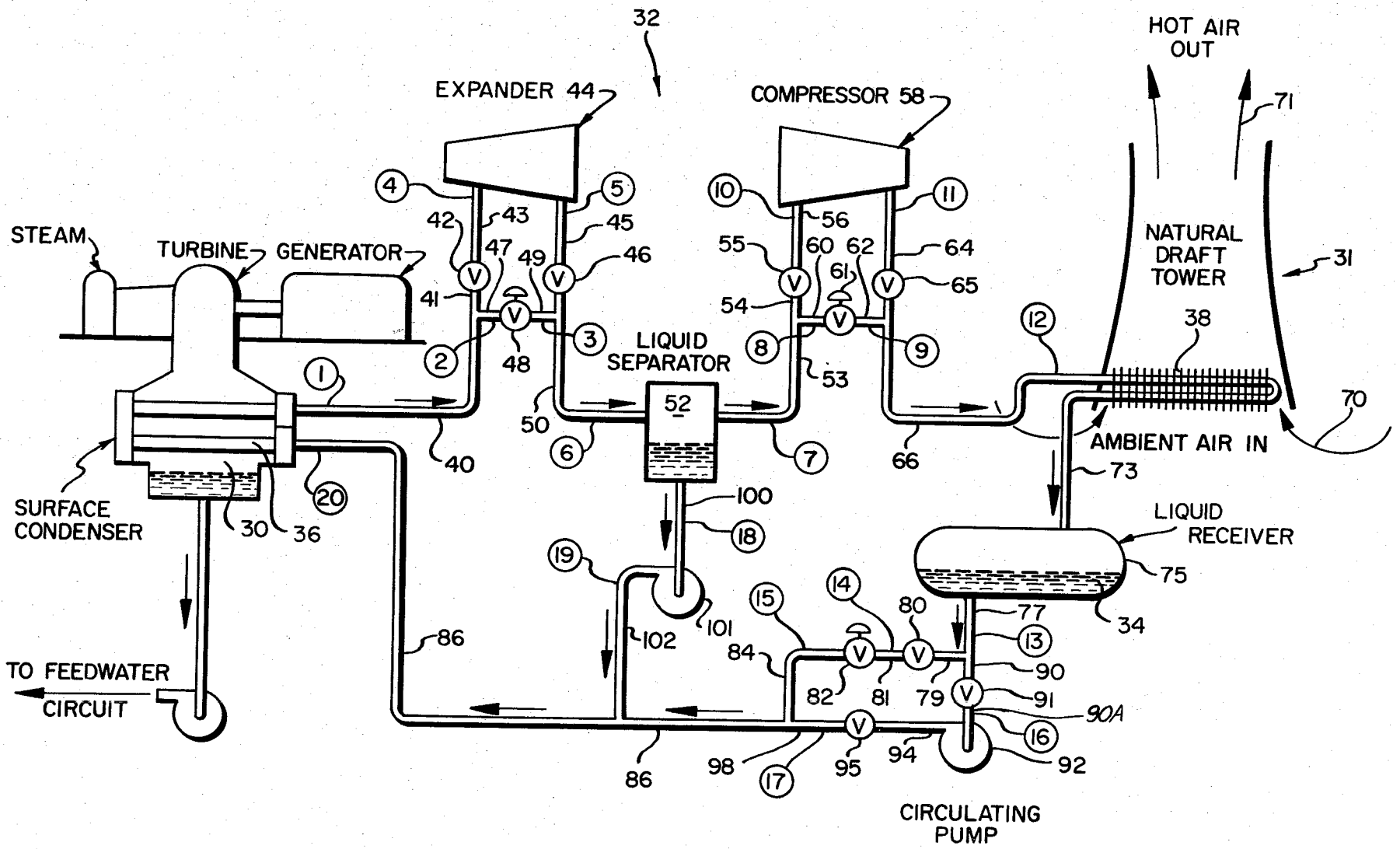

This invention relates to apparatus and methods of cooling and/or condensing a hot fluid stream. More particularly, this invention pertains to apparatus and methods of cooling and/or condensing a hot fluid stream, such as steam, with the production of power on relatively cool days and the consumption of power on relatively hot days.

Many commercial and industrial processes generate large amounts of waste heat which must be removed for successful operation. The waste heat is often carried in the form of a hot fluid stream. For a number of reasons, it is often undesirable or impermissible for the hot fluid stream to be disposed of, so it must be cooled and reused. One such hot fluid stream is spent steam, such as from an electric power generating steam turbine, which is condensed to water which then is reconverted to steam in a boiler to be used again in powering the turbine.

Regardless of the source of the hot fluid stream, a base cooling system of one type or another is provided for cooling the hot fluid stream. All such systems rely, ultimately, on heat rejection to the environment, either by direct rejection or indirectly through an intermediate fluid, to air or to water from a river, lake or sea.

A typical cooling system can be illustrated further by reference to a power generating plant. In the production of electric power, heat is first produced by nuclear energy or combustion of a fossil fuel such as oil, gas or coal. The heat produced is then used to convert water into steam. The steam is conducted at high pressure to a turbine which it drives. The turbine is, of course, coupled to a generator which produces electric power. The spent steam from the turbine is condensed by the cooling system and then recycled and reheated to steam again.

An air cooled system is generally designed and built to provide a cooling capacity or duty adequate for the intended purpose on the hottest day, or ambient temperature, anticipated at the site of the plant involved. This results in an excess cooling capacity for all but a small number of days out of a year. Even on the hottest days, the maximum cooling capacity of the system often is not utilized except during the very warmest part of the day. This is because the atmospheric temperature from day to night will vary as much as, or more than, 20° to 30° F., making it unnecessary to utilize the maximum cooling capacity of the system most of each day. The cooling system installation, operation and maintenance involve large costs and expenses which cover a system that is not anywhere fully employed regardless of the hot fluid stream to be cooled.

A water cooled system is generally designed for the highest temperature of the water from the available source, e.g., river, lake or sea. The cooling water picks up heat in condensing the steam. The heated water is disposed of into the river, and lake or sea but this is undesirable in certain areas because it causes the temperature of natural bodies of water to rise excessively, leading to ecological imbalance.

As an alternative, many power generating plants cool the heated water in an evaporative cooling tower by contacting it with ambient air. Large natural or mechanical draft cooling towers are extensively used for this purpose. While the heated water is cooled in this manner, a substantial amount is expelled as water vapor which may form artificial clouds leading to fog, ice and other problems in addition to the loss of fresh water which is increasingly scarce.

An evaporative cooling tower serving a 1000 megawatt electric generating plant may lose as much as 800,000 gallons of water per hour into the atmosphere. Also, the evaporative towers are susceptible to large bacteria growth causing additional environmental problems.

Various dry-type cooling systems have also been proposed. In one such system, ammonia is used in a closed loop to absorb heat in the steam condenser of a power generating plant and then reject heat in a cooling tower where air absorbs the heat from the ammonia coolant. This process is not very efficient in comparison to an evaporative or once-through water cooling system. One of the shortcomings of the system is that the temperature of the ammonia refrigerant entering the cooling tower is close to the temperature of the condensing steam, which in power plants ranges between 100° and 135° F. When the weather is hot and the ambient air flowing through the tower, for example, is about 95° F. or above, the temperature differential between the ammonia coolant and the ambient air is smaller than desired for efficient heat exchange. Also, the cooling tower cannot be designed for natural draft because of low differential temperatures between ambient air and the coolant temperature. To promote more efficient heat exchange in the cooling tower, the steam condensing temperatures may be increased but this leads to a higher turbine back pressure and lower turbine efficiency with a corresponding drop in power output. When the air temperature is lower than 90° F., better cooling is effected but the high costs of providing for peak ambient temperatures make the system uneconomical.

The pending United States patent application of Craig T. Bouchard et al. Ser. No. 942,766 filed Sept. 15, 1978, now U.S. Pat. No. 4,212,168 discloses a dry-type cooling system for condensing steam in a steam operated electrical power generating plant and disposing of the heat withdrawn, by converting some of the heat to a form of power or work, such as electric power, and rejecting some of the heat to the air. Although the system requires a power input at relatively high ambient air temperatures, such power consumption is more than offset on overall balance by the power produced in the period of cooling with ambient air at lower temperatures.

The Bouchard et al., supra, dry cooling system utilizes a closed loop containing a suitable refrigerant fluid. Included as part of the loop is a steam condenser adapted to be positioned in the hot-well of a steam system of an electric power generating plant, and a heat exchanger adapted to be located in a cooling tower through which air enters and flows at atmospheric or ambient temperature and exits at elevated temperature. The cooling capacity or duty of the heat exchanger and the cooling tower in which it is to be placed, are designed to provide adequate cooling of the refrigerant fluid on those days of high ambient or atmospheric temperature when the apparatus and method are in operation. The closed loop is suitably branched or bifurcated in such a way as to incorporate two individually, and alternatively but consecutively, operable cooling cycles employing the same refrigerant fluid. One of the cooling cycles is designed to operate when the atmospheric temperature of the air is comparatively high, such as above 80° F., and the other cooling cycle is designed to operate when the atmospheric temperature of the air is comparatively moderate, such as below 80° F. The cooling cycle operating at the higher temperatures, called a first cooling cycle for reference purposes, is a power consuming cycle while the cooling cycle operating at the lower temperatures, called a second cooling cycle for reference purposes, is a power generating cycle. Furthermore, it is calculated that the net power obtained from the power generating second cycle will be 3 to 4% of nominal plant capacity over a year of operation so that condensation of steam in the hot-well can be effected with a net gain in power production, rather than with a net power consumption as with prior art cooling systems. Over a yearly period, the entire cooling system is expected to produce as much as six times more power than it consumes. Of course, the cooling system employs no water so it is inherently effected without water loss or environmental disturbance and without thermal pollution.

The Bouchard et al., supra, system includes a compressor and an expander in the closed loop parallel to each other between the steam condenser in the hot-well and the heat exchanger inlet in the cooling tower. In addition, a liquid pump and an expansion valve are included in the closed loop parallel to each other between the heat exchanger outlet in the cooling tower and the steam condenser inlet in the hot-well. The compressor and the expansion valve operate together, with the expander and the liquid pump inactive, in the first cycle. In the second cycle the expander and the liquid pump operate together, with the compressor inactive and the expansion valve closed.

In the Bouchard, et al., supra, system the first cooling cycle is used only when the ambient air is comparatively hot. When the air temperature drops, such as at night and during cool weather periods, the second cooling cycle, which produces power, is automatically placed in operation and the first cooling cycle is cut out. Since a warm ambient air temperature is used for the apparatus design condition, excess cooling tower capacity is inherently available during normal and cooler weather. This makes use of a compressor unnecessary in the second cooling cycle. With the expander operating, power is produced.

Inherent in the system of Bouchard et al., supra, is a need during many times of the year, almost on a daily basis, to activate and inactivate the expander and the compressor according to which cooling cycle is operating or not operating. At other times it would be desirable to throttle the expander or compressor to better correlate its capacity with the cooling duty required by the power plant.

The expanders and compressors used in a cooling system like that of Bouchard et al., supra, are of very large size and are generally designed and built on a custom basis for a specific installation. They operate at high efficiency within the pressure and flow rate for which they were designed but their efficiency is lowered substantially when the pressure and flow rate through the machines are changed to the extent surge or choke conditions are reached.

A further limitation on the use of large size expanders and compressors is in the practical difficulty of starting and stopping them, with particular emphasis on starting them. Not only must great care be exercised to avoid creating self-destructing vibrations but, in addition, as much as an hour or more could be easily utilized in starting or stopping them. This will not only create operational problems, but will also increase the wear and tear on the machinery.

When the above characteristics of expanders and compressors are taken into account in the Bouchard et al., supra, system, it becomes clear that the compressor sized for near highest ambient or air temperature will have to be throttled at lower ambient or air temperatures after the head turn-down limit of the compressor is reached, which will be a potential waste of energy. Similarly, an expander sized for near the lowest ambient or air temperature will have to be shut down at a higher temperature after its turn down limit is reached, limiting the power producing capacity of the system.

According to the subject invention, it has been found that the apparatus and methods proposed by Bouchard et al., supra, for cooling and/or condensing a hot fluid stream can be substantially improved with no significant increase in capital cost or operating expense by integrating the compressor and expander so that (1) in an upper cooling cycle at the upper end of the ambient or air temperature range, only the compressor is operated within its operating range, (2) in a lower cooling cycle at the lower end of the ambient or air temperature range, only the expander is operated and (3) in a middle cooling cycle at the middle range of the ambient or air temperatures, when the turn-down of either the compressor or the expander is a limiting factor, both of them are operated.

The characteristics of the compressor and the expander are advisably matched such that when both are operated the duties on both are balanced above their respective turn-down limits thus minimizing the energy loss and enhancing the power producing capability of the system. The integrated compressor/expander operation, during the middle range of the ambient or air temperatures in which the system is designed to operate, will also provide smoother operation, as the discontinuity going to and from the compressor to the expander mode of operation in the Bouchard et al., supra, system is eliminated.

In the upper cooling cycle, operating in a complete installation above a predetermined or certain ambient or air temperature, the refrigerant vapor from the steam condenser is fed to the compressor, which increases the refrigerant pressure and its condensing temperature. Running the compressor, of course, requires power input. The pressurized refrigerant vapor is fed from the compressor to the heat exchanger in the cooling tower. The work of compression adds to the cooling duty of the cooling tower and substracts from the output of the electric power generating plant. The compressed refrigerant, which is at a temperature above the ambient or air temperature, condenses in the heat exchanger against the ambient air flowing through the cooling tower, and the air is heated to effect the heat rejection. The condensed refrigerant is then fed through the loop to the expansion valve. The pressure of the liquid refrigerant drops as it flows through the expansion valve to a lower pressure equal to the pressure in the steam condenser. The upper cooling cycle is completed when the refrigerant enters the steam condenser and is vaporized in it by condensing steam.

The lower cooling cycle operates at lower ambient or air temperatures by directing the refrigerant vapor from the hot-well or steam condenser to the expander. The thermal energy of the refrigerant vapor drives the expander which, in turn, is operably connected to an electric generator or other means to produce power or work. In this way power or work is produced during operation of the lower cycle. The expanded refrigerant vapor, upon exiting the expander at a lower pressure, is fed to the heat exchanger in the cooling tower in which it is cooled and condensed. While the refrigerant pressure is lowered by passing it through the expander, its pressure is maintained high enough to effect condensation in the heat exchanger in the cooling tower by rejection of heat to ambient air. The cooled refrigerant liquid is then fed from the heat exchanger to a liquid pump from which it is directed under pressure to the hot-well or steam condenser.

The middle cooling cycle operates in the middle ambient or air temperature range by directing the refrigerant vapor from the hot-well or steam condenser either to the expander first and then from the expander to the compressor or to the compressor first and then from the compressor to the expander. From the compressor or the expander the refrigerant vapor flows to the heat exchanger in the cooling tower. The condensed refrigerant is then fed through the loop to the expansion valve or the pump, as the conditions necessitate. The pressure of the liquid refrigerant drops or rises as it flows through the expansion valve or the pump to a pressure equal to the pressure in the steam condenser. The middle cooling cycle is then completed.

It should be clear that operating the compressor in the bottom portion of the ambient or air temperature range of the middle cooling cycle is not essential solely from a thermodynamic view point, and similarly that operating the expander in the top portion of the ambient or air temperature range in which the middle cooling is designed to operate is not essential solely from a thermodynamic view point. The expander and compressor are nevertheless integrated into the refrigeration loop to operate simultaneously in the middle cooling cycle so as to minimize turn-down or throttling problems which would otherwise frequently occur when the air temperature fluctuates daily, or over a few days, within an air temperature range that would otherwise require stopping the expander or compressor and starting the other of the two.

Depending on the location of the plant, such as in the United States, the system can be designed so that the lower cooling cycle will be in operation during the winter time with the generation of power and little consumption of power. During operation of the lower cooling cycle, the total heat rejected in the cooling tower heat exchanger will equal the heat rejected in the hot-well or steam condenser minus the heat rejected in the expander operation to generate power or other work. This can be represented by the equation: Q(cooling tower total)=Q(hot well)−Q(expander). As the temperature of the ambient or atmospheric air increases, the heat converted to power or work by the expander continuously decreases as the temperature differental between the expanded refrigerant fed to the heat exchanger and the ambient air flowing through the cooling tower is narrowed. Ultimately, no power or work would be generated by the expander. At that point the heat rejected by the cooling tower heat exchanger would equal the heat rejected to the refrigerant in the hot-well or steam condenser. In the above equation Q (expander) would equal zero (0) so that the equation would read: Q(cooling tower)=Q(hot well). However, considerably before that condition is reached, a crossover is effected from the lower cooling cycle to the middle cooling cycle, which is activated. This crossover is effected considerably before the capacity of the expander to produce power is exceeded so as to avoid loss of expander efficiency and to avoid turn-down problems that would occur with change in heat rejection ability because of frequent temperature swings in ambient air temperature.

Operation of the middle cooling cycle can be represented by the following heat (Q) balance formula: Q(cooling tower total)=Q(hot-well)−Q(expander)=Q(compressor).

Crossover from the middle cooling cycle to the upper cooling cycle is effected somewhat before the ambient or atmospheric air temperature reaches a point where the operation of the expander is no longer practical because of loss of efficiency and reduction in power production to a level where it is no longer significant. The expander operation is then discontinued and the upper cooling cycle used with only the compressor running. During operation of the upper cooling cycle, the heat (Q) balance formula is as follows: Q(cooling tower total)=Q(hot well)+Q(compressor). The compressor, when operating alone, continues to raise the pressure of the refrigerant fluid to permit efficient heat rejection in the cooling tower and condensation of the refrigerant fluid in the heat exchanger located therein.

The composition of the refrigerant fluid must be selected so that it will vaporize by heat rejection from the steam in the hot-well and be condensed by passage through the heat exchanger in the cooling tower regardless of which cycle is in operation. In such a system the refrigerant may leave the hot-well condenser as a saturated vapor at its bubble point and it may leave the heat exchanger in the cooling tower as a saturated liquid at its dew point.

In designing a cooling system employing this invention, the pressure v. enthalpy curves for various refrigerants are examined for optimum refrigerating effect and optimum compression and expansion differential enthalpies. The temperature v. enthalpy characteristics of the refrigerant should provide optimum heat exchange in the cooling tower.

Refrigerants such as ammonia, propane, butane and other hydrocarbons can be used alone or in suitable admixtures which are compatible. A particular refrigerant fluid which can be used in the described system of this invention, such as for condensing waste steam at 100° F. to 135° F. in a hot-well of an electric power generating plant, is ammonia, isobutane alone or isobutane containing up to about 10 weight percent propane or other mixtures. Reference is made to Maher et al. U.S. Pat. No. 3,914,949 for further information on a mixed refrigerant single loop refrigeration cycle.

A novel combination of apparatus according to one embodiment of the invention for utilizing the cooling system for removal of heat from exhaust or spent steam from a steam driven electric generating power plant in which the steam must be condensed in a hot-well before the water can be reconverted to steam, comprises:

(a) a closed loop containing a refrigerant fluid, (b) a condenser having a refrigerant inlet and outlet in the closed loop and positioned to effect spent steam condensation in the hot-well by indirect heat exchange with refrigerant fluid flowing through the condenser, (c) a heat exchanger having a refrigerant inlet and outlet in the closed loop and adapted to be located in a cooling tower to effect indirect heat exchange between refrigerant fluid flowing through the heat exchanger and atmospheric temperature air flowing through the cooling tower to cool the refrigerant fluid, (d) an expander positioned in the loop between the outlet of the steam condenser and the inlet of a compressor, (e) a compressor positioned in the loop between the expander outlet and the heat exchanger inlet, (f) a separator in the loop at the outlet of the expander separating refrigerant liquid from refrigerant vapor, (g) an expander by-pass conduit communicating with the loop on the upstream and downstream sides of the expander, (h) a compressor by-pass conduit communicating with the loop on the upstream and downstream sides of the compressor, (i) a liquid pump and an expansion valve positioned parallel to one another in the loop between the outlet of the heat exchanger and the inlet of the condenser, (j) a liquid refrigerant conduit communicating with the separator and with the loop downstream of the liquid pump and the expansion valve but ahead of the condenser inlet, (k) means to close the expander by-pass conduit, open the compressor by-pass conduit, activate the expander and the liquid pump, inactivate the compresser and close the expansion valve, when the temperature of the atmospheric air flowing through the cooling tower is at least low enough to condense refrigerant vapor in the cooling tower heat exchanger at a pressure lower than the pressure of the refrigerant vapor exiting the condenser, to thereby extract energy by means of the expander for use in producing power or work, (l) means to close the expander by-pass conduit, close the compressor by-pass conduit, activate the expander and the compressor, open the expansion valve or activate the liquid pump, when the temperature of the atmospheric air flowing through the cooling tower is in the middle range of the ambient temperature to effect efficient heat exchange and condensation of the refrigerant in the cooling tower heat exchanger, and (m) means to open the expander by-pass conduit, close the compressor by-pass conduit, activate the compressor and open the expansion valve, and inactivate the expander and the liquid pump, when the temperature of the atmospheric air flowing through the cooling tower is close to being too high to effect efficient heat exchange and condensation of the refrigerant in the cooling tower heat exchanger without compressing the refrigerant.

The described apparatus advisably also includes pump means for delivering refrigerant liquid from the separator to the downstream side of the liquid pump when the expander is operating. It also desirably includes a refrigerant liquid reservoir vessel in the closed loop between the heat exchanger and the inlets of the liquid pump and the expansion valve.

A novel combination of apparatus according to a second embodiment of the invention for utilizing the cooling system for removal of heat from exhaust or spent steam from a steam driven electric generating power plant in which the steam must be condensed in a hot-well before the water can be reconverted to steam, comprises:

(a) a closed loop containing a refrigerant fluid, (b) a condenser having a refrigerant inlet and outlet in the closed loop and positioned to effect spent steam condensation in the hot-well by indirect heat exchange with refrigerant fluid flowing through the condenser, (c) a heat exchanger having a refrigerant inlet and outlet in the closed loop and adapted to be located in a cooling tower to effect indirect heat exchange between refrigerant fluid flowing through the heat exchanger and atmospheric temperature air flowing through the cooling tower to cool the refrigerant fluid, (d) a compressor positioned in the loop between the outlet of the steam condenser and the inlet of an expander, (e) an expander positioned in the loop between the compressor outlet and the heat exchanger inlet, (f) a compressor by-pass conduit communicating with the loop on the upstream and downstream sides of the compressor, (g) an expander by-pass conduit communicating with the loop on the upstream and downstream sides of the expander, (h) a liquid pump and an expansion valve positioned parallel to one another in the loop between the outlet of the heat exchanger and the inlet of the condenser, (i) means to close the expander by-pass conduit, open the compressor by-pass conduit, activate the expander and the liquid pump, inactivate the compressor and close the expansion valve, when the temperature of the atmospheric air flowing through the cooling tower is at least low enough to condense refrigerant vapor in the cooling tower heat exchanger at a pressure lower than the pressure of the refrigerant vapor exiting the condenser, to thereby extract energy by means of the expander for use in producing power or work, (j) means to close the expander by-pass conduit, close the compressor by-pass conduit, activate the expander and the compressor, open the expansion valve or activate the liquid pump, when the temperature of the atmospheric air flowing through the cooling tower is in the middle range of the ambient temperature to effect efficient heat exchange and condensation of the refrigerant in the cooling tower heat exchanger, and (k) means to open the expander by-pass conduit, close the compressor by-pass conduit, activate the compressor and open the expansion valve, and inactivate the expander and the liquid pump, when the temperature of the atmospheric air flowing through the cooling tower is below but close to being too high to effect efficient heat exchange and condensation of the refrigerant in the cooling tower heat exchanger without compressing the refrigerant.

This embodiment of the apparatus advisably also includes a refrigerant liquid reservoir vessel in the closed loop between the heat exchanger and the inlets of the liquid pump and the expansion valve.

Figure 2:
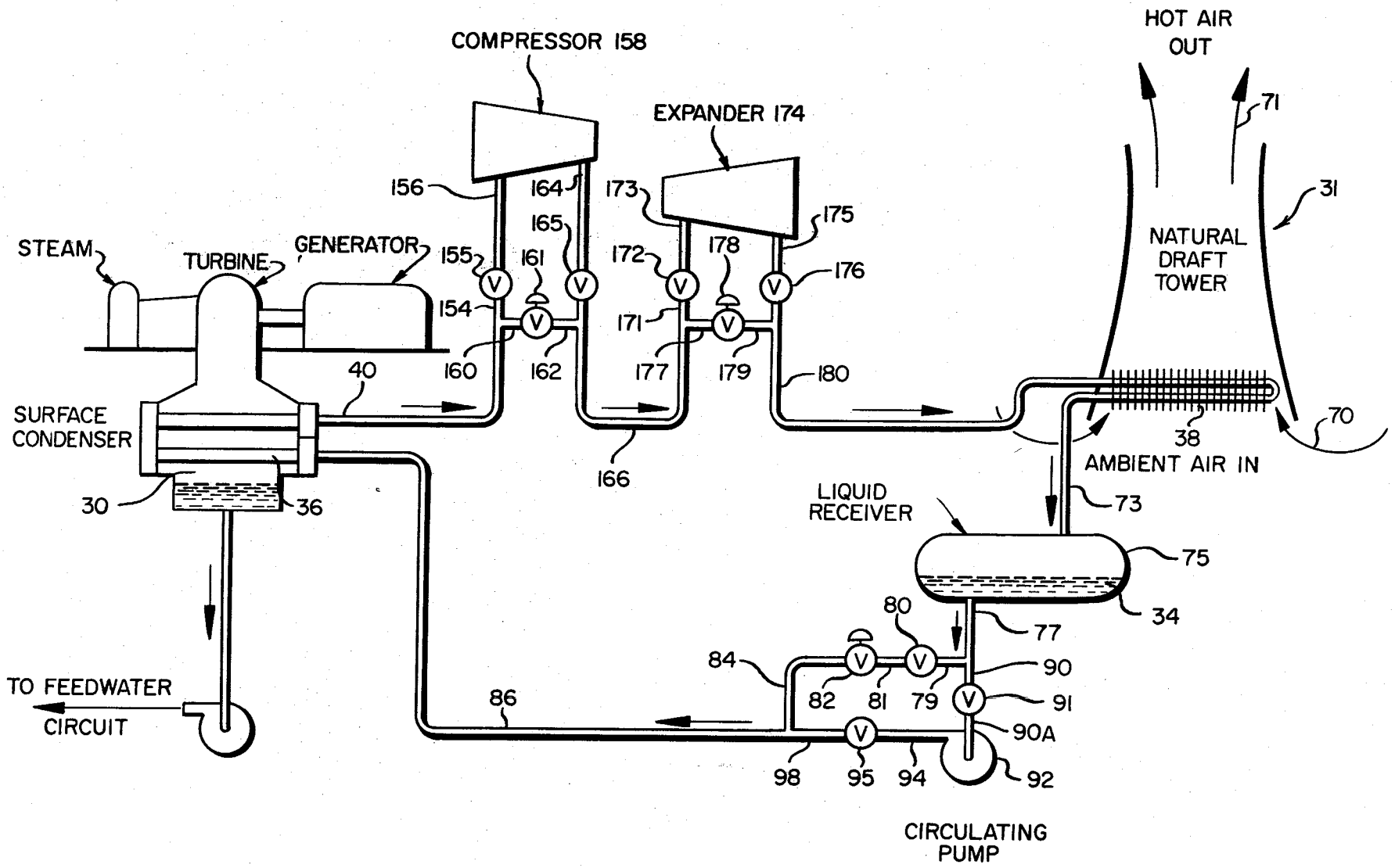

The invention will be described further in conjunction with the attached drawings, in which:

FIG. 1 is a diagrammatic drawing of one embodiment of apparatus according to the invention in which the compressor is downstream of the expander; and FIG. 2 is a diagrammatic drawing of a second embodiment of apparatus according to the invention in which the expander is downstream of the compressor.

So far as is practical, the same elements or parts will be identified in both drawings by the same numbers.

With reference to FIG. 1 of the drawings, the hot-well 30 is intended to represent that part of a steam driven electric generating power plant in which exhausted or spent steam, usually at a temperature of about 100° to 135° F., is condensed to water. The hot-well will, of course, be enclosed and operate typically at a back pressure of about 1 to 5 in. of mercury.

The cooling tower 31 is desirably of a natural draft type although it can be a mechanical draft tower in which air blows up through the tower. In both types of towers, the ambient or atmospheric temperature air 70 enters at the bottom of the cooling tower and the heated air 71 flows out the top. The tower can be a steel or concrete shell having its bottom above ground level so that air can enter.

Extending from the hot-well 30 (FIG. 1) and the cooling tower 31 is a closed loop 32 containing a refrigerant fluid 34. The closed loop includes a steam condenser 36 located in hot-well 30 and a heat exchanger 38 located in cooling tower 31. Refrigerant vapor is conducted from condenser 36 by conduit 40. When the expander 44 is operating, conduit 40 delivers the refrigerant vapor to conduit 41, through open valve 42 to conduit 43 which delivers it to expander 44. The expander by-pass consisting of conduit 47, valve 48 and conduit 49 are not in use when the expander is operating and valve 48 is closed.

The expander 44 (FIG. 1) can be used to provide power or to perform work. Thus, it can be used to drive an electric generator and the electricity so produced can be fed to transmission lines, used to charge batteries or be converted to heat and stored as thermal energy for subsequent use. Expander 44 can also be used to operate a pump or compressor which can be used to compress a gas or to pump water to storage for later use, such as in electric generation. The expander can also be used to power fuel cells or drive fans.

The expanded refrigerant vapor flows from expander 44, through conduit 45 and open valve 46 to conduit 50 which delivers the mixture of vapor and liquid refrigerant to liquid refrigerant separator 52. Refrigerant vapor is removed from separator 52 by conduit 53 and sent through conduit 54, open valve 55 and conduit 56 to compressor 58. When the compressor is operating, the compressor by-pass consisting of conduit 60, closed valve 61 and conduit 62 is not used.

Compressed vapor is removed from compressor 58 by conduit 64 and sent through open valve 65 to conduit 66 which delivers the refrigerant vapor to heat exchanger 38 in which it is condensed to liquid refrigerant. After passing through the heat exchanger 38, conduit 73 delivers the condensed refrigerant liquid to vessel 75 which holds a volume of refrigerant 34 in the liquid state. The refrigerant liquid is fed by conduit 77 to conduit 79, through open valve 80 to conduit 81 which delivers it to expansion valve 82. Alternatively, should the conditions require it, the refrigerant liquid is fed by conduit 77 through conduit 90 through open valve 91 to conduit 90A to liquid pump 92. The lower pressure cold refrigerant flows from expansion valve 82 to conduit 84 which delivers it to conduit 86. Conduit 86 delivers the liquid refrigerant to the inlet side of steam condenser 36 in which the refrigerant is vaporized by heat exchange with the spent steam in the hot-well.

The liquid refrigerant accumulated in separator 52 is withdrawn by conduit 100 and fed to liquid pump 101 from which it is delivered to conduit 102 which feeds it to conduit 86. This operation continues throughout the cooling cycle so long as liquid refrigerant is produced and removed in separator 52. However, at very high atmospheric air temperatures little liquid refrigerant will be removed at that point in the upper cooling cycle in which the compressor, but not the expander, is operating.

The cooling system as so far described with respect to FIG. 1 pertains to the conditions which exist when the middle cooling cycle is in operation and in which the expander and compressor are both running simultaneously. In summary, during operation of the middle cooling cycle valves 48, 61, 91 and 95 or 80 and 82 are closed and valves 42, 46, 55, 65, 80 and 82 or 91 and 95 are open.

When the upper cooling cycle is operating, valves 42 and 46 are closed and valve 48 is open to by-pass expander 44, valves 55 and 65 are open and valve 61 is closed so that compressor 58 operates, valves 91 and 95 are closed and valve 80 is open to by-pass pump 92 so that liquid refrigerant can be fed to expansion valve 82 and from it to conduit 84 and then to conduit 86.

When the lower cooling cycle is operating, valves 42 and 46 are open and valve 48 is closed so that expander 44 operates, valves 55 and 65 are closed and valve 61 is open to by-pass compressor 58, valve 80 is closed to by-pass expansion valve 82, valve 91 is open so that liquid refrigerant can be fed to pump 92, and valve 95 is open so that the liquid refrigerant can be fed to conduit 98 and from it to conduit 86.

The following Tables I through V, which are to be considered together, present calculated operating conditions for a specific cooling system of the invention, according to the embodiment of FIG. 1, for a steam driven turbine for a 650 MW electric power generating plant designed to maintain a hot-well at a maximum temperature of 134° F. with a maximum back pressure of 5 in. of mercury and a heat rejection requirement of $3.069\times10^9$ BTU/hr at the hot-well. The calculations are based on ammonia as the refrigerant. The numbers in circles at the top of the columns are the same numbers used in FIG. 1. The data in the columns indicates the conditions at these points in the apparatus where the circled numbers are located according to the atmospheric air temperature.

TABLE I

| Air Temp. °F. | Annual Hours | Hot Well Pressure Inch Hg. | Hot Well Temp. °F. | Compressor Penalty KW | Turbine Penalty KW | Pump Penalty-KW Circulating | Pump Penalty-KW Condensate | Expander Gain KW |
|---|---|---|---|---|---|---|---|---|
| 99 | 1 | 5.00 | 134 | 32,101 | 15,598 | — | — | — |
| 97 | 9 | 4.74 | 132 | 31,567 | 12,745 | — | — | — |
| 92 | 39 | 4.14 | 127 | 30,858 | 6,325 | — | — | — |
| 87 | 127 | 5.00 | 134 | 31,800 | 15,598 | 40 | 110 | 15,900 |
| 82 | 461 | 4.62 | 131 | 31,480 | 11,319 | 179 | 110 | 18,660 |
| 72 | 1,301 | 4.04 | 126 | 30,910 | 5,133 | 440 | 110 | 24,750 |
| 62 | 1,604 | 4.04 | 126 | 31,380 | 5,133 | 870 | 110 | 37,070 |
| 52 | 1,155 | 4.04 | 126 | 30,710 | 5,133 | 1,197 | 110 | 48,480 |

TABLE I-continued

| Air Temp. °F. | Annual Hours | Hot Well Pressure Inch Hg. | Hot Well Temp. °F. | Compressor Penalty KW | Turbine Penalty KW | Pump Penalty-KW Circulating | Pump Penalty-KW Condensate | Expander Gain KW |
|---|---|---|---|---|---|---|---|---|
| 47 | 755 | 4.04 | 126 | — | 5,133 | 1,348 | 110 | 36,380 |
| 42 | 1,255 | 3.93 | 125 | — | 4,086 | 1,420 | 110 | 40,840 |
| 32 | 1,309 | 3.52 | 121 | — | 195 | 1,448 | 110 | 47,510 |
| 22 | 544 | 2.97 | 115 | — | −3,967 | 1,374 | 110 | 51,990 |
| 12 | 167 | 2.29 | 106 | — | −7,821 | 1,204 | 110 | 52,760 |
| 2 | 33 | 2.00 | 101 | — | −9,085 | 1,168 | 110 | 52,760 |

TABLE II

| Air Temp. °F. | Net Gain or Loss KW | Total Compressor Loss $10^6$ KWH | Total Turbine Loss $10^6$ KWH | Total Pump Loss $10^6$ KWH Cir/Cond. | Total Expander Gain $10^6$ KWH | Total Gain or Loss $10^6$ KWH |
|---|---|---|---|---|---|---|
| 99 | −47,699 | −0.032 | −0.016 | — | — | −0.048 |
| 97 | −44,312 | −0.284 | −0.115 | — | — | −0.399 |
| 92 | −37,183 | −1.203 | −0.247 | — | — | −1.450 |
| 87 | −31,648 | −4.039 | −1.981 | −0.005<br>−0.014 | 2.019 | −4.019 |
| 82 | −24,428 | −14.512 | −5.218 | −0.083<br>−0.051 | 8.602 | −11.261 |
| 72 | −11,843 | −40.214 | −6.678 | −0.572<br>−0.143 | 32.200 | −15.408 |
| 62 | −423 | −50.334 | −8.233 | −1.395<br>−0.176 | 59.460 | −0.679 |
| 52 | 11,330 | −35.470 | −5.929 | −1.383<br>−0.127 | 55.994 | 13.086 |
| 47 | 29,789 | — | −3.875 | −1.018<br>−0.083 | 27.467 | 22.491 |
| 42 | 35,224 | — | −5.128 | −1.782<br>−0.138 | 51.254 | 44.206 |
| 32 | 45,757 | — | −0.255 | −1.895<br>−0.144 | 62.191 | 59.896 |
| 22 | 54,473 | — | 2.158 | −0.747<br>−0.060 | 28.283 | 29.633 |
| 12 | 59,267 | — | 1.306 | −0.201<br>−0.018 | 8.811 | 9.898 |
| 2 | 60,567 | — | 0.300 | −0.039<br>−0.004 | 1.741 | 1.999 |

TABLE III*

| Air Temp. °F. | Circled Point on FIG. 1: 1 | 2 | 3 | 4 | 5 | 6 | 7 |
|---|---|---|---|---|---|---|---|
| 99 | P = 331.6<br>T = 130.3<br>F = 424,563 | Same as 1 | Same as 1 | — | — | Same as 1 | Same as 1 |
| 97 | P = 322.4<br>T = 128.3<br>F = 420,731 | Same as 1 | Same as 1 | — | — | Same as 1 | Same as 1 |
| 92 | P = 300.2<br>T = 123.3<br>F = 411,073 | Same as 1 | Same as 1 | — | — | Same as 1 | Same as 1 |
| 87 | P = 331.6<br>T = 130.3<br>F = 408,650 | — | — | Same as 1 | P = 274.2<br>T = 117.0<br>F = 408,650 | Same as 5 | P = 274.2<br>T = 117.0<br>F = 399,259 |
| 82 | P = 317.9<br>T = 127.3<br>F = 400,970 | — | — | Same as 1 | P = 253.2<br>T = 111.7<br>F = 400,970 | Same as 5 | P = 253.2<br>T = 111.7<br>F = 390,330 |
| 72 | P = 295.9<br>T = 122.3<br>F = 386,744 | — | — | Same as 1 | P = 216.3<br>T = 101.4<br>F = 386,744 | Same as 5 | P = 216.3<br>T = 101.4<br>F = 373,481 |
| 62 | P = 295.9<br>T = 122.3<br>F = 376,458 | — | — | Same as 1 | P = 182.1<br>T = 90.5<br>F = 376,458 | Same as 5 | P = 182.1<br>T = 90.5<br>F = 357,526 |
| 52 | P = 295.9<br>T = 122.3<br>F = 366,879 | — | — | Same as 1 | P = 153.4<br>T = 80.1<br>F = 366,879 | Same as 5 | P = 153.4<br>T = 80.1<br>F = 343,147 |
| 47 | P = 295.9<br>T = 122.3<br>F = 362,674 | — | — | Same as 1 | P = 175.4<br>T = 88.2<br>F = 362,674 | Same as 5 | P = 175.4<br>T = 88.2<br>F = 344,178 |
| 42 | P = 291.7<br>T = 121.3<br>F = 357,932 | — | — | Same as 1 | P = 165.8<br>T = 84.8<br>F = 357,932 | Same as 5 | P = 165.8<br>T = 84.8<br>F = 337,530 |
| 32 | P = 275.1 | — | — | Same | P = 139.5 | Same | P = 139.5 |

TABLE III*-continued

| Air Temp. °F. | Circled Point on FIG. 1 1 | 2 | 3 | 4 | 5 | 6 | 7 |
|---|---|---|---|---|---|---|---|
| | T = 117.3 | | | as | T = 74.5 | as | T = 74.5 |
| | F = 348,027 | | | 1 | F = 348,027 | 5 | F = 325,405 |
| 22 | P = 251.7 | — | — | Same | P = 116.8 | Same | P = 116.8 |
| | T = 111.3 | | | as | T = 64.4 | as | T = 64.4 |
| | F = 338,526 | | | 1 | F = 338,526 | 5 | F = 314,829 |
| 12 | P = 219.4 | — | — | Same | P = 97.6 | Same | P = 97.6 |
| | T = 102.3 | | | as | T = 54.6 | as | T = 54.6 |
| | F = 330,023 | | | 1 | F = 330,023 | 5 | F = 307,251 |
| 2 | P = 204.1 | — | — | Same | P = 80.6 | Same | P = 80.6 |
| | T = 97.6 | | | as | T = 44.6 | as | T = 44.6 |
| | F = 322,737 | | | 1 | F = 322,737 | 5 | F = 297,886 |

*P = psia
T = °F.
F = Mol/Hr

TABLE IV*

| Air Temp. °F. | Circled Point on FIG. 1 8 | 9 | 10 | 11 | 12 | 13 | 14 |
|---|---|---|---|---|---|---|---|
| 99 | — | — | P = 331.6 | P = 405.4 | Same | P = 400.4 | Same |
| | | | T = 130.3 | T = 157.7 | as | T = 144.0 | as |
| | | | F = 424,563 | F = 424,563 | 11 | F = 424,563 | 13 |
| 97 | — | — | P = 322.4 | P = 394.1 | Same | P = 389.1 | Same |
| | | | T = 128.3 | T = 155.5 | as | T = 141.9 | as |
| | | | F = 420,731 | F = 420,731 | 11 | F = 420,731 | 13 |
| 92 | — | — | P = 300.2 | P = 366.9 | Same | P = 361.9 | Same |
| | | | T = 123.3 | T = 150.3 | as | T = 136.9 | as |
| | | | F = 411,073 | F = 411,073 | 11 | F = 411,073 | 13 |
| 87 | — | — | P = 274.2 | P = 338.7 | Same | P = 333.7 | — |
| | | | T = 117.0 | T = 145.2 | as | T = 130.7 | |
| | | | F = 399,259 | F = 399,259 | 11 | F = 399,259 | |
| 82 | — | — | P = 253.2 | P = 314.0 | Same | P = 309.0 | — |
| | | | T = 111.7 | T = 139.9 | as | T = 125.3 | |
| | | | F = 390,330 | F = 390,330 | 11 | F = 390,330 | |
| 72 | — | — | P = 216.3 | P = 269.6 | Same | P = 264.6 | — |
| | | | T = 101.4 | T = 129.8 | as | T = 114.6 | |
| | | | F = 373,481 | F = 373,481 | 11 | F = 373,481 | |
| 62 | — | — | P = 182.1 | P = 229.7 | Same | P = 224.7 | — |
| | | | T = 90.5 | T = 120.0 | as | T = 103.8 | |
| | | | F = 357,526 | F = 357,526 | 11 | F = 357,526 | |
| 52 | — | — | P = 153.4 | P = 194.9 | Same | P = 189.9 | — |
| | | | T = 80.1 | T = 109.9 | as | T = 93.1 | |
| | | | F = 343,147 | F = 343,147 | 11 | F = 343,147 | |
| 47 | Same | Same | — | — | P = 180.4 | P = 175.4 | — |
| | as | as | | | T = 89.9 | T = 88.2 | |
| | 7 | 7 | | | F = 344,178 | F = 344,178 | |
| 42 | Same | Same | — | — | P = 165.8 | P = 160.8 | — |
| | as | as | | | T = 84.8 | T = 82.9 | |
| | 7 | 7 | | | F = 337,530 | F = 337,530 | |
| 32 | Same | Same | — | — | P = 139.5 | P = 134.5 | — |
| | as | as | | | T = 74.5 | T = 72.4 | |
| | 7 | 7 | | | F = 325,405 | F = 325,405 | |
| 22 | Same | Same | — | — | P = 116.8 | P = 111.8 | — |
| | as | as | | | T = 64.4 | T = 62.0 | |
| | 7 | 7 | | | F = 314,829 | F = 314,829 | |
| 12 | Same | Same | — | — | P = 97.6 | P = 92.6 | — |
| | as | as | | | T = 54.6 | T = 51.8 | |
| | 7 | 7 | | | F = 307,251 | F = 307,251 | |
| 2 | Same | Same | — | — | P = 80.6 | P = 75.6 | — |
| | as | as | | | T = 44.6 | T = 41.4 | |
| | 7 | 7 | | | F = 297,886 | F = 297,886 | |

*P = psia
T = °F.
F = Mol/Hr

TABLE V*

| Air Temp. °F. | Circled Point on FIG. 1 15 | 16 | 17 | 18 | 19 | 20 |
|---|---|---|---|---|---|---|
| 99 | P = 336.6 | — | — | — | — | P = 336.6 |
| | T = 131.3 | | | | | T = 131.3 |
| | F = 424,563 | | | | | F = 424,563 |
| 97 | P = 327.4 | — | — | — | — | P = 327.4 |
| | T = 129.3 | | | | | T = 129.3 |

TABLE V*-continued

| Air Temp. °F. | Circled Point on FIG. 1 (15) | (16) | (17) | (18) | (19) | (20) |
|---|---|---|---|---|---|---|
| 92 | F = 420,731<br>P = 305.2<br>T = 124.4<br>F = 411,073 | — | — | — | — | F = 420,731<br>P = 305.2<br>T = 124.4<br>F = 411,073 |
| 87 | — | P = 333.7<br>T = 130.7<br>F = 399,259 | P = 336.6 | P = 274.2<br>T = 117.0<br>F = 9331 | P = 336.6<br>F = 9391 | P = 336.6<br>T = 131.3<br>F = 408,650 |
| 82 | — | P = 309.0<br>T = 125.3<br>F = 390,330 | P = 322.9 | P = 253.2<br>T = 111.7<br>F = 10,640 | P = 322.9<br>F = 10,640 | P = 322.9<br>T = 128.3<br>F = 400,970 |
| 72 | — | P = 264.6<br>T = 114.6<br>F = 373,481 | P = 300.9 | P = 216.3<br>T = 101.4<br>F = 13,263 | P = 300.9<br>F = 13,263 | P = 300.9<br>T = 123.3<br>F = 386,744 |
| 62 | — | P = 224.7<br>T = 103.8<br>F = 357,526 | P = 300.9 | P = 182.1<br>T = 90.5<br>F = 18,932 | P = 300.9<br>F = 18,932 | P = 300.9<br>T = 123.9<br>F = 376,458 |
| 52 | — | P = 189.9<br>T = 93.1<br>F = 343,147 | P = 300.9 | P = 153.4<br>T = 80.1<br>F = 23,732 | P = 300.9<br>F = 23,732 | P = 300.9<br>T = 123.9<br>F = 366,879 |
| 47 | — | P = 175.4<br>T = 88.2<br>F = 344,178 | P = 300.9 | P = 175.4<br>T = 88.2<br>F = 18,496 | P = 300.9<br>F = 18,496 | P = 300.9<br>T = 88.2<br>F = 362,674 |
| 42 | — | P = 160.8<br>T = 82.9<br>F = 337,530 | P = 296.7 | P = 165.8<br>T = 84.8<br>F = 20,402 | P = 296.7<br>F = 20,402 | P = 296.7<br>T = 82.9<br>F = 357,932 |
| 32 | — | P = 134.5<br>T = 72.4<br>F = 325,405 | P = 280.1 | P = 139.5<br>T = 74.5<br>F = 22,622 | P = 280.1<br>F = 22,622 | P = 280.1<br>T = 72.4<br>F = 348,027 |
| 22 | — | P = 111.8<br>T = 62.0<br>F = 314,829 | P = 256.7 | P = 116.8<br>T = 64.4<br>F = 23,697 | P = 256.7<br>F = 23,697 | P = 256.7<br>T = 62.0<br>F = 338,526 |
| 12 | — | P = 92.6<br>T = 51.8<br>F = 307,251 | P = 224.4 | P = 97.6<br>T = 54.6<br>F = 22,772 | P = 224.4<br>F = 22,772 | P = 224.4<br>T = 51.8<br>F = 330,023 |
| 2 | — | P = 75.6<br>T = 41.4<br>F = 297,886 | P = 209.1 | P = 80.6<br>T = 44.6<br>F = 24,851 | P = 209.1<br>F = 24,851 | P = 209.1<br>T = 41.1<br>F = 322,737 |

*P = psia
T = °F.
F = Mol/Hr

FIG. 2 illustrates a second embodiment of novel apparatus which can be used in practicing the dry cooling process provided by the invention. In this embodiment, the compressor is located in the loop upstream of the expander.

With reference to FIG. 2, the refrigerant vapor is conducted from condenser 36 by conduit 40 through conduit 154, open valve 155 and conduit 156 to compressor 158. When the compressor is operating, the compressor by-pass consisting of conduit 160, closed valve 161 and conduit 162 is not used.

Compressed vapor is removed from compressor 158 by conduit 164 and sent through open valve 165 to conduit 166 which delivers the refrigerant vapor to conduit 171, through open valve 172 to conduit 173 which delivers it to expander 174. The expander by-pass consisting of conduit 177, valve 178 and conduit 179 are not in use when the expander is operating and valve 178 is closed. The expanded refrigerant vapor flows from expander 174, through conduit 175 and open valve 176 to conduit 180 which delivers the refrigerant vapor to heat exchanger 38 in which it is condensed.

Both the compressor and expander operate in series simultaneously as described during the middle cooling cycle.

In summary, during operation of the middle cooling cycle valves 178, 161, 91 and 95 are closed and valves 172, 176, 155, 165 and 80 are open.

When the upper cooling cycle is operating, valves 172 and 176 are closed and valve 178 is open to by-pass the expander 174, and valves 161, 91 and 95 are maintained closed.

Whenever the compressor is in operation, expansion valve 82 will also be used. However, during compressor operation, liquid refrigerant will not be sent by conduit 77 to conduit 90 and through valve 91 to liquid refrigerant pump 92 because during compressor operation valve 91 is closed.

When the lower cooling cycle is operating, valves 172 and 176 are open and valve 178 is closed so that the expander operates, valves 155 and 165 are closed and valve 161 is open to take the compressor out of operation, valve 80 is closed to by-pass expansion valve 82, valve 91 is open so that liquid refrigerant can be fed to pump 92, and valve 95 is open so that the liquid refrigerant can be fed to conduit 98 and from it to conduit 86.

The foregoing detailed description has been given for clearness of understanding only, and no unnecessary limitations should be understood therefrom, as modifications will be obvious to those skilled in the art.

What is claimed is:

1. Apparatus for removal of heat from exhaust or spent steam from a steam driven electric generating power plant in which the steam must be condensed in a hot-well before the water can be reconverted to steam, comprising:

(a) a closed loop containing a refrigerant fluid, (b) a condenser having a refrigerant inlet and outlet in the closed loop and positioned to effect spent steam condensation in the hot-well by indirect heat exchange with refrigerant fluid flowing through the condenser, (c) a heat exchanger having a refrigerant inlet and outlet in the closed loop and adapted to be located in a cooling tower to effect indirect heat exchange between refrigerant fluid flowing through the heat exchanger and atmospheric temperature air flowing through the cooling tower to cool the refrigerant fluid, (d) an expander positioned in the loop between the outlet of the steam condenser and the inlet of a compressor, (e) a compressor positioned in the loop between the expander outlet and the heat exchanger inlet, (f) a separator in the loop at the outlet of the expander separating refrigerant liquid from refrigerant vapor, (g) an expander by-pass conduit communicating with the loop on the upstream and downstream sides of the expander, (h) a compressor by-pass conduit communicating with the loop on the upstream and downstream sides of the compressor, (i) a liquid pump and an expansion valve positioned parallel to one another in the loop between the outlet of the heat exchanger and the inlet of the condenser, (j) a liquid refrigerant conduit communicating with the separator and with the loop downstream of the liquid pump and the expansion valve but ahead of the condenser inlet, (k) means to close the expander by-pass conduit, open the compressor by-pass conduit, activate the expander and the liquid pump, inactivate the compressor and close the expansion valve, when the temperature of the atmospheric air flowing through the cooling tower is at least low enough to condense refrigerant vapor in the cooling tower heat exchanger at a pressure lower than the pressure of the refrigerant vapor exiting the condenser, to thereby extract energy by means of the expander for use in producing power or work, (l) means to close the expander by-pass conduit, close the compressor by-pass conduit, activate the expander and the compressor, open the expansion valve or activate the liquid pump, when the temperature of the atmospheric air flowing through the cooling tower is in the middle of the ambient temperature range to effect efficient heat exchange and condensation of the refrigerant in the cooling tower heat exchanger, and (m) means to open the expander by-pass conduit, close the compressor by-pass conduit, activate the compressor and open the expansion valve, and inactivate the expander and the liquid pump, when the temperature of the atmospheric air flowing through the cooling tower is close to being too high to effect efficient heat exchange and condensation of the refrigerant in the cooling tower heat exchanger without compressing the refrigerant.

2. Apparatus according to claim 1 in which the refrigerant is isobutane containing up to 10% by weight propane.

3. Apparatus according to claim 1 in which the refrigerant is isobutane.

4. Apparatus according to claim 1 in which the refrigerant is propane.

5. Apparatus according to claim 1 in which the refrigerant is ammonia.

6. Apparatus according to claim 1 in which the refrigerant is a hydrocarbon, or a mixture of hydrocarbons.

7. Apparatus according to claim 1 including a refrigerant liquid reservoir vessel in the closed loop between the heat exchanger and the inlets of the liquid pump and the expansion valve.

8. Apparatus according to claim 1 including pump means for delivering refrigerant liquid from the separator to the downstream side of the liquid pump when the expander is operating.

9. In a method of removing heat from exhaust or spent steam from a steam driven electric generating power plant in which the steam must be condensed in a hot-well before the water can be reconverted to steam, said method using a closed loop containing a refrigerant fluid, a condenser having a refrigerant inlet and outlet in the closed loop and positioned to effect spent steam condensation in the hot-well by indirect heat exchange with refrigerant fluid flowing through the condenser, and a heat exchanger having a refrigerant inlet and outlet in the closed loop and adapted to be located in a cooling tower to effect indirect heat exchange between refrigerant fluid flowing through the heat exchanger and atmospheric temperature air flowing through the cooling tower to cool the refrigerant fluid, the improvement comprising:

(a) expanding the refrigerant vapor after it leaves the condenser, and before it enters the heat exchanger, to generate power when the temperature of the atmospheric air flowing through the cooling tower is at least low enough to condense the refrigerant vapor in the cooling tower, (b) expanding the refrigerant vapor after it leaves the condenser and then comprising the refrigerant before it enters the heat exchanger, when the temperature of the atmospheric air flowing through the cooling tower is in the middle of the ambient temperature range, and (c) compressing the refrigerant vapor after it leaves the condenser and without first expanding the vapor leaving the condenser, and before it enters the heat exchanger, when the temperature of the atmospheric air flowing through the cooling tower is close to being too high to effect efficient heat exchange and condensation of the refrigerant in the cooling tower heat exchanger unless the refrigerant is compressed.

10. The improvement according to claim 9 in which the refrigerant is ammonia.

11. The improvement according to claim 9 in which the refrigerant is isobutane containing some propane in an amount up to 10% by weight.

12. The improvement according to claim 9 in which the refrigerant is isobutane.

13. The improvement according to claim 9 in which the refrigerant is propane.

14. The improvement according to claim 9 in which the refrigerant is a hydrocarbon, or a mixture of hydrocarbons.

15. Apparatus for removal of heat from exhaust or spent steam from a steam driven electric generating power plant in which the steam must be condensed in a hot-well before the water can be reconverted to steam, comprising:

(a) a closed loop containing a refrigerant fluid, (b) a condenser having a refrigerant inlet and outlet in the closed loop and positioned to effect spent steam condensation in the hot-well by indirect heat exchange with refrigerant fluid flowing through the condenser, (c) a heat exchanger having a refrigerant inlet and outlet in the closed loop and adapted to be located in a cooling tower to effect indirect heat exchange between refrigerant fluid flowing through the heat exchanger and atmospheric temperature air flowing through the cooling tower to cool the refrigerant fluid, (d) a compressor positioned in the loop between the outlet of the condenser and the inlet of an expander, (e) an expander positioned in the loop between the compressor outlet and the heat exchanger inlet, (f) a compressor by-pass conduit communicating with the loop on the upstream and downstream sides of the compressor, (g) an expander by-pass conduit communicating with the loop on the upstream and downstream sides of the expander, (h) a liquid pump and an expansion valve positioned parallel to one another in the loop between the outlet of the heat exchanger and the inlet of the condenser, (i) means to close the expander by-pass conduit, open the compressor by-pass conduit, activate the expander and the liquid pump, inactivate the compressor and close the expansion valve, when the temperature of the atmospheric air flowing through the cooling tower is at least low enough to condense refrigerant vapor in the cooling tower heat exchanger at a pressure lower than the pressure of the refrigerant vapor exiting the condenser, to thereby extract energy by means of the expander for use in producing power or work, (j) means to close the expander by-pass conduit, close the compressor by-pass conduit, activate the expander and the compressor, open the expansion valve or inactivate the liquid pump, when the temperature of the atmospheric air flowing through the cooling tower is in the middle of the ambient temperature range to effect efficient heat exchange and condensation of the refrigerant in the cooling tower heat exchanger, and (k) means to open the expander by-pass conduit, close the compressor by-pass conduit, activate the compressor and open the expansion valve, and inactivate the expander and the liquid pump, when the temperature of the atmospheric air flowing through the cooling tower is below but close to being too high to effect efficient heat exchange and condensation of the refrigerant in the cooling tower heat exchanger without compressing the refrigerant.

16. Apparatus according to claim 15 in which the refrigerant is isobutane containing up to 10% by weight propane.

17. Apparatus according to claim 15 in which the refrigerant is isobutane.

18. Apparatus according to claim 15 in which the refrigerant is propane.

19. Apparatus according to claim 15 in which the refrigerant is ammonia.

20. Apparatus according to claim 15 in which the refrigerant is a hydrocarbon, or a mixture of hydrocarbons.

21. Apparatus according to claim 15 including a refrigerant liquid reservoir vessel in the closed loop between the heat exchanger and the inlets of the liquid pump and the expansion valve.

22. In a method of removing heat from exhaust or spent steam from a steam driven electric generating power plant in which the steam must be condensed in a hot-well before the water can be reconverted to steam, said method using a closed loop containing a refrigerant fluid, a condenser having a refrigerant inlet and outlet in the closed loop and positioned to effect spent steam condensation in the hot-well by indirect heat exchange with refrigerant fluid flowing through the condenser, and a heat exchanger having a refrigerant inlet and outlet in the closed loop and adapted to be located in a cooling tower to effect indirect heat exchange between refrigerant fluid flowing through the heat exchanger and atmospheric temperature air flowing through the cooling tower to cool the refrigerant fluid, the improvement comprising:

(a) expanding the refrigerant vapor after it leaves the condenser, and before it enters the heat exchanger, to generate power when the temperature of the atmospheric air flowing through the cooling tower is at least low enough to condense the refrigerant vapor in the cooling tower, (b) compressing the refrigerant vapor after it leaves the condenser and then expanding the refrigerant before it enters the heat exchanger, when the temperature of the atmospheric air flowing through the cooling tower is in the middle of the ambient temperature range, and (c) compressing the refrigerant vapor after it leaves the condenser and without subsequently expanding the vapor before it enters the heat exchanger, when the temperature of the atmospheric air flowing through the cooling tower is close to being too high to effect efficient heat exchange and condensation of the refrigerant in the cooling tower heat exchanger unless the refrigerant is compressed.

23. The improvement according to claim 22 in which the refrigerant is ammonia.

24. The improvement according to claim 22 in which the refrigerant is isobutane containing some propane in an amount up to 10% by weight.

25. The improvement according to claim 22 in which the refrigerant is isobutane.

26. The improvement according to claim 22 in which the refrigerant is propane.

27. The improvement according to claim 22 which the refrigerant is a hydrocarbon, or a mixture of hydrocarbons.

* * * * *

UNITED STATES PATENT AND TRADEMARK OFFICE

CERTIFICATE OF CORRECTION

PATENT NO. : 4,291,538

DATED : September 29, 1981

INVENTOR(S) : Matloob Husain, Ban-Yen Lai, and James B. Maher

It is certified that error appears in the above-identified patent and that said Letters Patent are hereby corrected as shown below:

Column 4, line 52, change "substracts" to --subtract--;

Column 5, line 58, change "differental" to --differential--;

Column 6, line 12, change "=" to --+--;

Table IV, column 13, change "136.9" to --136.6--;

Table V, place each of the column heading numbers in a circle so they read 15 16 17 18 19 20;

Table V, column 18, third entry from the top, change "9331" to --9391--;

Table V, column 20, second entry up from the bottom, change "41.1" to --41.4--;

Column 18, line 37, change "comprising" to --compressing--;

Column 20, line 59, after "22" insert --in--.

Signed and Sealed this

Eighth Day of December 1981

[SEAL]

Attest:

GERALD J. MOSSINGHOFF

Attesting Officer

Commissioner of Patents and Trademarks